US007614963B2

(12) United States Patent
Cheng

(10) Patent No.: US 7,614,963 B2
(45) Date of Patent: Nov. 10, 2009

(54) GOLF CLUB SHAFT INSERT ASSEMBLIES, INSERT ASSEMBLY SYSTEMS AND APPARATUS FOR USE WITH SAME

(76) Inventor: Michael H. L. Cheng, 5369 Evening Sky Dr., Simi Valley, CA (US) 93063

( * ) Notice: Subject to any disclaimer, the term of this patent is extended or adjusted under 35 U.S.C. 154(b) by 0 days.

(21) Appl. No.: 11/627,363

(22) Filed: Jan. 25, 2007

(65) Prior Publication Data

US 2007/0111815 A1 May 17, 2007

(51) Int. Cl.

| | |
|---|---|
| ***A63B 53/10*** | (2006.01) |
| ***A63B 53/12*** | (2006.01) |
| ***B25F 1/00*** | (2006.01) |
| ***B25B 23/00*** | (2006.01) |

(52) U.S. Cl. ..... 473/318; 81/437; 81/459

(58) Field of Classification Search ..... 473/316–323, 473/296–299, 523; 81/436–438, 459–461, 81/177.2; 403/109.1, 109.3, 109.4, 109.5, 403/109.9

See application file for complete search history.

(56) References Cited

U.S. PATENT DOCUMENTS

| | | | | | |
|---|---|---|---|---|---|
| 1,465,929 | A | * | 8/1923 | Buck | 81/119 |
| 2,133,696 | A | | 10/1938 | Hall | |
| 2,508,039 | A | | 5/1950 | Neuwirth | |
| 2,999,706 | A | | 9/1961 | Wilcox | |
| 3,773,375 | A | | 11/1973 | Nehls | |
| 3,833,223 | A | | 9/1974 | Shulkin | |
| 4,214,395 | A | | 7/1980 | Caldwell, Jr. | |
| 4,319,750 | A | | 3/1982 | Roy | |
| 4,476,751 | A | * | 10/1984 | Mishima | 81/440 |
| 4,561,922 | A | | 12/1985 | Peerman et al. | |
| 4,738,046 | A | | 4/1988 | Fraylick et al. | |
| 4,826,168 | A | | 5/1989 | McGuire | |
| 4,893,519 | A | | 1/1990 | Corso et al. | |
| 5,054,781 | A | | 10/1991 | Soong | |
| 5,080,363 | A | | 1/1992 | Soong | |
| 5,133,455 | A | * | 7/1992 | Chow | 206/374 |
| 5,205,552 | A | | 4/1993 | Green | |
| 5,267,733 | A | | 12/1993 | Szokola | |
| 5,324,032 | A | | 6/1994 | Minami | |
| 5,588,920 | A | | 12/1996 | Soong | |
| 5,692,971 | A | | 12/1997 | Williams | |
| 5,735,752 | A | | 4/1998 | Antonious | |
| 5,904,627 | A | | 5/1999 | Miyaji et al. | |
| 5,924,937 | A | | 7/1999 | Kuo | |
| 6,045,457 | A | | 4/2000 | Soong | |
| 6,056,646 | A | | 5/2000 | Soong | |
| 6,056,648 | A | | 5/2000 | Kusumoto et al. | |
| 6,113,508 | A | | 9/2000 | Locarno et al. | |

(Continued)

FOREIGN PATENT DOCUMENTS

| | | |
|---|---|---|
| JP | 06-047115 A | 2/1994 |

OTHER PUBLICATIONS

PCT Search Report dated May 28, 2008 for PCT App. Ser. No. PCT/US2008/051506.

*Primary Examiner*—Stephen L. Blau
(74) *Attorney, Agent, or Firm*—Henricks, Slavin & Holmes LLP

(57) ABSTRACT

Insert assemblies for use with a golf club shaft including an insert and an insert lock, insert assembly systems, and apparatus for use with insert assemblies.

11 Claims, 7 Drawing Sheets

U.S. PATENT DOCUMENTS 6,155,932 A 12/2000 Cabales et al.
6,224,596 B1 5/2001 Jackson
6,231,456 B1 5/2001 Rennie et al.
6,241,623 B1 6/2001 Laibangyang
6,257,997 B1 7/2001 Doble et al.
6,302,614 B1 10/2001 Tseng
6,308,590 B1 10/2001 Berto
6,349,451 B1 2/2002 Newman et al.
6,354,960 B1 3/2002 Perryman et al.
6,361,451 B1 3/2002 Masters et al.
6,364,787 B1 4/2002 Huiskamp
6,364,789 B1 4/2002 Kosmatka
6,447,404 B1 9/2002 Wilbur
6,485,376 B1 11/2002 Hisamatsu
6,490,761 B2 * 12/2002 Durrant ..... 16/436
D479,293 S 9/2003 Bergling Olson
6,656,058 B2 12/2003 Thompson et al.
6,666,778 B2 12/2003 Ashida
6,755,752 B2 6/2004 Shimizu et al.
6,764,414 B2 7/2004 Kumamoto
6,773,358 B1 8/2004 Sumitomo et al.
6,797,208 B2 9/2004 Schikner
6,953,196 B1 * 10/2005 Huang ..... 279/75
6,973,858 B2 * 12/2005 Huang ..... 81/177.85
7,036,401 B2 * 5/2006 Carroll ..... 81/177.2
7,062,997 B2 * 6/2006 Hu ..... 81/177.2
7,479,069 B2 1/2009 Cheng
7,494,423 B2 2/2009 Cheng
7,500,921 B2 3/2009 Cheng
2001/0005696 A1 6/2001 Hedrick
2001/0007835 A1 7/2001 Baron
2002/0187850 A1 12/2002 Kluck et al.
2003/0027658 A1 2/2003 Li et al.
2004/0165940 A1 * 8/2004 Fotino et al. ..... 403/122
2004/0211300 A1 * 10/2004 Wang ..... 81/177.2
2005/0009620 A1 1/2005 Hodgetts
2005/0054459 A1 3/2005 Oldenburg
2005/0079925 A1 4/2005 Cheng et al.
2006/0183563 A1 8/2006 Nemeckay
2007/0111814 A1 5/2007 Cheng
2008/0110305 A1 * 5/2008 Tsai ..... 81/451

* cited by examiner

GOLF CLUB SHAFT INSERT ASSEMBLIES, INSERT ASSEMBLY SYSTEMS AND APPARATUS FOR USE WITH SAME

CROSS-REFERENCE TO RELATED APPLICATIONS

This application is related to concurrently filed U.S. application Ser. No. 11/627,361.

BACKGROUND OF THE INVENTIONS

1. Field of the Inventions

The present inventions relate generally to golf clubs.

2. Description of the Related Art

Fiber reinforced resin shafts are commonly used in golf club drivers and irons. Such shafts, which are typically hollow and consist of a shaft wall formed around a tapered mandrel, may be produced with varying stiffness and bending profiles. As a result, golfers are able to choose shafts that are appropriate for their particular swing. If a shaft is too stiff for the golfer, then the shaft will not deflect sufficiently to generate a "kick" behind the golf ball. Conversely, if the shaft is not stiff enough, then the shaft will either lead or lag excessively, thereby causing the ball to leave the club head at a launch angle that is higher or lower than intended. Golfers typically make their shaft stiffness and bending profile determinations by trial and error.

In order to allow golfers to experiment with variations in staff stiffness and bending profile without purchasing a plurality of shafts, commonly owned U.S. Patent Pub. No. 2005/0079925 A1 proposes removable and interchangeable inserts that may be used to alter the stiffness and/or bending profile of a shaft. Although such inserts have proven to be quite helpful, the present inventor has determined that they are susceptible to improvement.

BRIEF DESCRIPTION OF THE DRAWINGS

Detailed description of embodiments of the inventions will be made with reference to the accompanying drawings.

DETAILED DESCRIPTION

Figure 1:
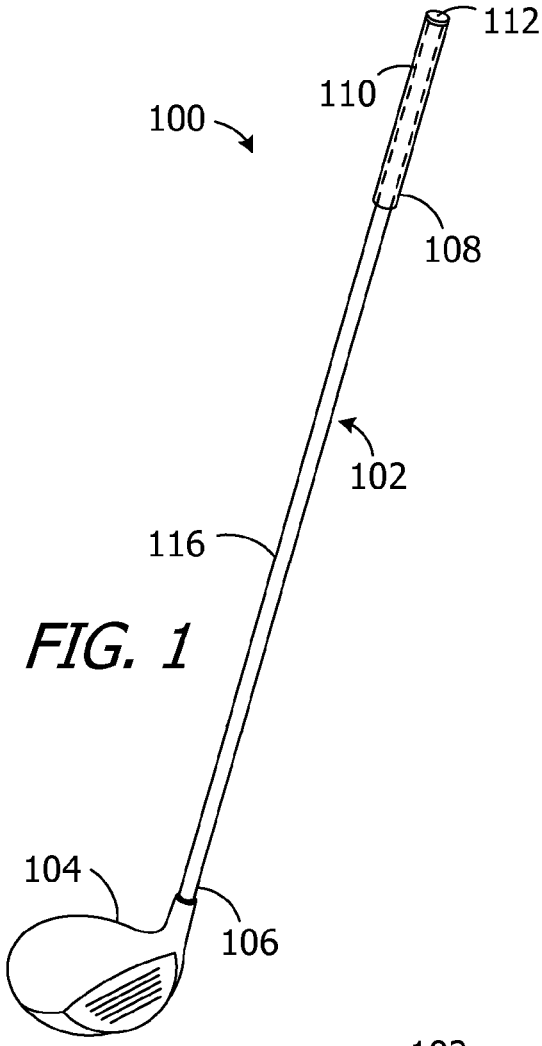
FIG. 1 is a side view of a golf club in accordance with one embodiment of a present invention.

The following is a detailed description of the best presently known modes of carrying out the inventions. This description is not to be taken in a limiting sense, but is made merely for the purpose of illustrating the general principles of the inventions. Additionally, although the present inventions are described in the context of fiber reinforced resin composite golf club shafts because the inventions are particularly well suited to such shafts, the inventions are not so limited and are applicable to a wide variety of golf club shafts, including those currently available and those yet to be developed.

The exemplary golf club 100 illustrated in FIGS. 1-4 includes a shaft 102 with a club head 104 on the tip section 106 and a grip 108 on the grip section 110. The exemplary shaft 102 is a tapered fiber reinforced resin composite shaft. An end cap 112 covers the shaft butt end 114. The section of the shaft 102 between the tip section 106 and the grip section 110 is referred to herein as the main section 116. Although the present inventions are not limited to any particular golf club configurations, the exemplary golf club 100 is a "driver" and the club head 104 is a driver type club head. The present inventions are, however, equally applicable to any and all golf clubs including, but not limited to, all "woods," "irons," and "wedges." It should also be noted that the illustrated grip 108 and end cap 112 arrangement may be replaced by a continuous, integrally formed grip that covers both the shaft grip section 110 and butt end 114.

The golf club 100 also includes one or more insert assemblies, which are generally represented by reference numerals 200 (FIG. 2) and 200*a* (FIG. 4), that may be removably secured within the shaft 102. The exemplary insert assembly 200 illustrated in FIG. 2 includes a relatively short insert 202 and an insert lock 204. The exemplary insert assembly 200 is sized and shaped such that it is spaced from the shaft butt end 114 and occupies a portion of the shaft grip section 110 and a portion of the main section 116. The exemplary insert assembly 200*a*, which also includes a relatively short insert 202*a* and an insert lock 204*a*, is sized and shaped for use within the portion of the main section 116 near the tip section 106. The inserts 202 and 202*a* alter the stiffness and/or bending profile of the shaft 102 and, typically, the golfer will experiment with a number of insert assemblies 200 and/or 200*a* of varying length, stiffness and bending profile.

Depending on the intended adjustment to the shaft 102, the insert assembly 200 may be secured within the shaft without the insert assembly 200*a*, both insert assemblies may be secured within the shaft, or the insert assembly 200*a* may secured within the shaft without the insert assembly 200. In other words, the golfer may choose to employ a single insert that alters the stiffness of the golf club shaft main section 116 near the grip section, or to employ a pair of inserts that respectfully alter the stiffness of the main section near the tip section and the grip section, or to employ a single insert that alters the stiffness of the main section near the tip section. It should also be noted here that three or more insert assemblies may be employed in other implementations.

The insert locks 204 and 204*a*, which are discussed in greater detail below in the context of FIGS. 5-7, frictionally engage the inner surface 118 of the associated portions of the shaft 102 to hold the inserts 202 and 202*a* in place. As a result, the insert locks 204 and 204*a* facilitate the use of inserts that do not extend to the butt end 114 of the associated shaft 102, where as disclosed in U.S. Patent Pub. No. 2005/0079925 A1, the end cap 112 would prevent longitudinal movement of inserts which lack locks and extend to the butt end. The use of inserts that do not extend to the butt end of the associated shaft provides golfers with additional choices while attempting to determine the optimal stiffness and bending profile, and also facilitates the use of more than one insert within the same shaft at the same time. Moreover, the use of one relatively short insert (or two relatively short inserts) allows the golfer to selectively alter the stiffness of a particular portion (or portions) of the shaft without adding the full weight associated with an insert that extends from approximately one end of the shaft to the other.

Figure 2:
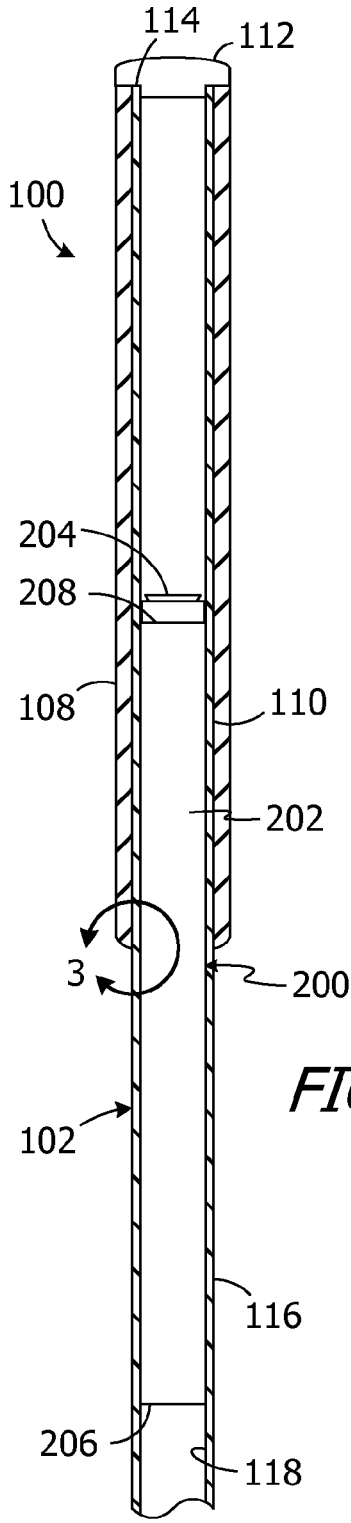
FIG. 2 is a partial section view of the golf club illustrated in FIG. 1 with an insert assembly in accordance with one embodiment of a present invention associated with the grip section of the golf club shaft.
Figure 3:
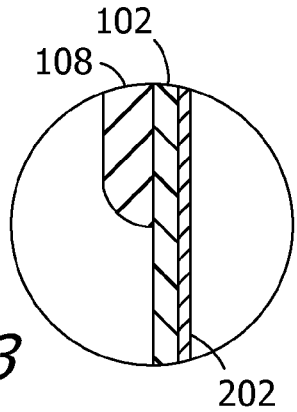
FIG. 3 is an enlarged view taken along line 3 in FIG. 2.
Figure 4:
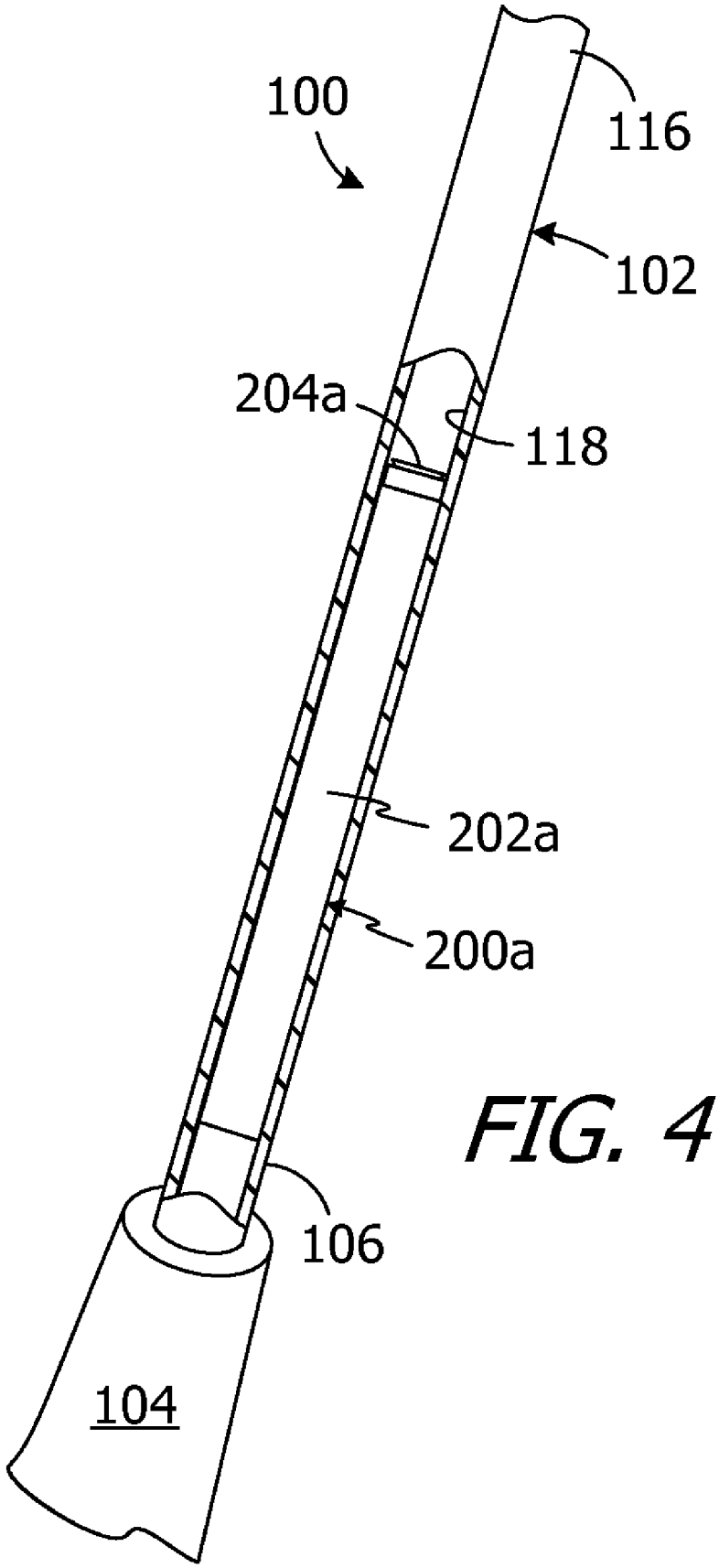
FIG. 4 is a partial section view of the golf club illustrated in FIG. 1 with an insert assembly in accordance with one embodiment of a present invention adjacent to the tip section of the golf club shaft.

The inserts 202 and 202*a* in the exemplary insert assemblies 200 and 200*a* illustrated in FIGS. 2 and 4 are configured to fit into particular portions of the golf club shaft 102. The outer perimeter of the inserts 202 and 202*a* and the perimeter of the associated portions of the shaft inner surface 118 are extremely close in shape and dimension. For example, and referring to FIG. 2, if the shaft 102 is a tapered shaft, the insert 202 will typically have the same taper and the tip end 206 of the insert will have an outer diameter that is substantially the same as the diameter of the portion of the shaft inner surface 118 where insert tip end is to be located. The insert tip end 206 will, of course, be prevented from moving beyond this point because the inner diameter of the tapered shaft 102 beyond this point will be smaller than the outer diameter of the insert tip end. The outer diameter of the insert 202 will also be substantially the same as the inner diameter of the associated portion of the shaft from the insert tip end 206 to the insert butt end 208. This causes a frictional engagement (or "press fit") between the shaft 102 and the insert 202. The insert 202*a* is similarly configured according to its intended location within the shaft 102. With respect to wall thickness (i.e. the difference between the inner diameter and the outer diameter), the inserts 202 and 202*a* may have a constant wall thickness or one that varies.

In those instances where the golf club shaft is not tapered from tip end to butt end, e.g. in those instances where the shaft has a tapered main section and cylindrical tip and grip sections, the insert may be shaped accordingly. For example, the insert may be tapered over its entire length and dimensioned so as to reside only in the shaft main section, or the insert may be tapered over the substantial majority of its length and have a short cylindrical grip section that is coextensive with a small portion of the grip section of the shaft.

Turning to the dimensions of the exemplary embodiments, the length of the relatively short insert 202 will typically range from about 4 inches to about 20 inches and the exemplary insert 202 is about 12 inches in length. The insert length may also be a function of intended position. For example, the insert 202 may be re-configured such that its tip end 206 is in the location illustrated in FIG. 2, while the butt end 208 is either located closer to, or further from, the main section 116 (yet still within the grip section 110) or the butt end is located within the shaft main section. The outer diameter of the insert 202 may, depending on the length of the insert and the size of the associated golf club shaft, range from about 8 mm to 12 mm at the tip end to about 10 mm to 14 mm at the butt end. The length of the relatively short insert 202*a* will typically range from about 4 inches to about 20 inches and the exemplary insert 202*a* is about 12 inches in length. The outer diameter may, depending on the length of the insert and the size of the associated golf club shaft, range from about 4 mm to 8 mm at the tip end to about 7 mm to 11 mm at the butt end.

With respect to materials, the inserts 202 and 202*a* may be formed from relatively light weight materials, such as graphite or a polymer. A typical weight is about 15 grams or less. Different portions of the inserts may also be made from different materials if desired. The inserts may be manufactured to the desired lengths or manufactured to set lengths and then cut as necessary. Dimensional marking may be provided to facilitate accurate cuts. Suitable graphite insert manufacturing techniques include sheet-wrapping, filament-winding, and internal bladder molding, among other appropriate techniques. For example, one or more layers of Toray graphite material (e.g. Toray T700, M30, M40J, M46J or M50J) may be sheet-wrapped around a layer of light weight (e.g. about 100 g/m$^2$ or less) scrim or a layer of graphite pre-preg. Suitable polymer manufacturing techniques include injection molding. The outer surface of the inserts 202 and 202*a* may, in some instances, be coated with a coating that improves the fit between the insert and the golf club shaft 102 and reduces noise that may result from the engagement of the insert and the shaft. One example of such a coating is a soft polyurethane based coating. Additional details concerning inserts is provided in U.S. Patent Pub. No. 2005/0079925 A1, which is incorporated herein by reference.

Figure 5:
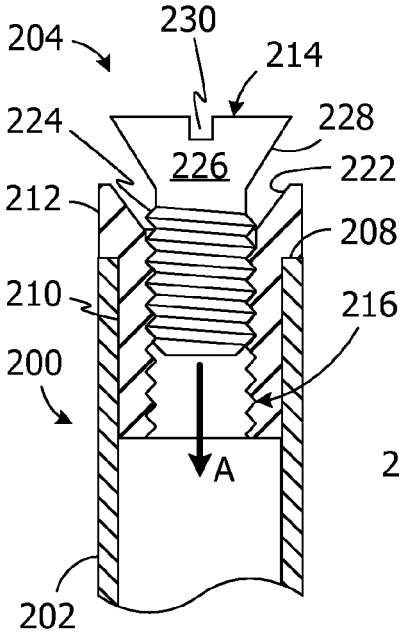
FIG. 5 is a partial section view showing a portion of the insert assembly illustrated in FIG. 2.
Figure 6:
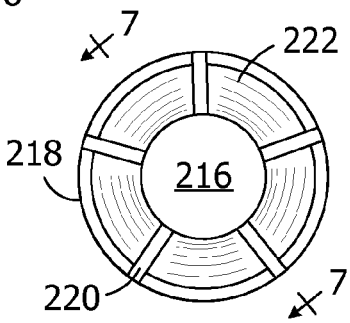
FIG. 6 is a top view of the base portion of an insert lock in accordance with one embodiment of a present invention.
Figure 7:
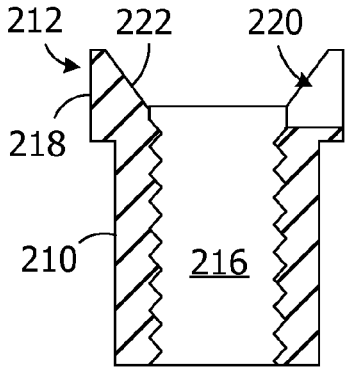
FIG. 7 is a section view taken along line 7-7 in FIG. 6.

Turning to FIGS. 5-7, the insert lock 204 in the exemplary insert assembly 200 includes a base 210 that is positioned within the insert 202 at the insert butt end 208, an expandable member 212 that is carried by the base, and a longitudinally movable member 214. As discussed in greater detail below, the expandable member 212 will frictionally engage the inner surface 118 of the golf club shaft 102 when the insert lock 204 is in the locked state. The frictional engagement between the expandable member 212 and the inner surface 118 of the golf club shaft 102 prevents the insert assembly 200 from moving relative to the shaft, i.e. locks the insert assembly in place, as is explained below with reference to FIGS. 8 and 9. It should also be noted here that the insert lock 204*a* is identical to the insert lock 204, but for dimensions, and functions in the same way to hold the insert assembly 200*a* in place. As such, the description of the insert lock 200 is also applicable to the insert lock 200*a*.

The exemplary base 210 is a hollow, generally cylindrical or slightly tapered structure that includes a threaded lumen 216 which receives the longitudinally movable member 214. The base 210 performs the function of mounting the expandable member 212 onto the insert 202. In the illustrated embodiment, the base 210 is permanently secured to the insert 202. As used herein, the phrase "permanently secured" means that the base cannot be removed from the insert 202 by hand without excessive effort. For example, the base 210 may be permanently secured to the insert 202 with a high strength adhesive from the class of adhesives commonly referred to as "structural adhesives" or "engineering adhesives." Such adhesives include epoxy, polyurethane, acrylic, cyanoacrylate adhesives. A permanently secured base 210 could also be an integral part of the insert 202 in those instances where the insert and base are molded as a single unit. In other embodiments, the base 210 may simply be removably inserted into the butt end 208 so that, for example, a single insert lock 204 may be used with a plurality of different inserts 202. Here, however, the insert 202 and base 210 should be mechanically keyed in order to prevent rotation of the base relative to the insert during the locking and unlocking operations described below with reference to FIGS. 13-19.

The expandable member 212 is movable between an unexpanded (or "unlocked") state, where the expandable member does not frictionally engage inner surface 118 of the shaft 102 with enough force to prevent longitudinal movement of the insert assembly 200 relative to shaft 102, and an expanded (or "locked") state where the expandable member would, if it were not located within the shaft, expand beyond the outer perimeter insert butt end 208. However, when the insert lock 204 is located within the shaft 102, the expandable member 212 will frictionally engage the shaft inner surface 118 when in the expanded state with enough force to prevent longitudinal movement of the insert assembly relative to shaft. In the illustrated embodiment, and referring to FIGS. 6 and 7, the expandable member 212 is biased to the unlocked state, is integral with the base portion 210, and consists of a plurality (e.g. five) expandable portions 218. The expandable portions 218, which are separated from one another by slots 220, include sloped engagement surfaces 222. The inner surfaces of the expandable portions 218 may also be threaded, as they are in the illustrated embodiment, so as to form a continuation of the threaded lumen 216.

As illustrated in FIG. 5, the exemplary longitudinally movable member 214 includes a threaded shaft 224 that is configured to mate with the base member threaded lumen 216. Rotation of the longitudinally movable member 214 in one direction causes the longitudinally movable member to move toward the base member 210 and rotation in the opposite direction causes the longitudinally movable member to move away from the base member. The longitudinally movable member 214 also includes an engagement portion 226 with a sloped engagement surface 228 and a tool connector 230. The slopes of the engagement surfaces 222 and 228 may be the same, as shown, or different. Movement of the longitudinally movable member 214 in the direction of arrow A will result in the engagement surface 228 coming into contact with the engagement surfaces 222 and, as movement continues, the expandable members 218 being driven outwardly. One example of a device that may be used as the longitudinally movable member 214 is a flat head (or "countersunk") screw. Such a screw may have a slotted opening type tool connector 230, as shown, or may have a Phillips opening, Hex opening, Robertson (or "square") opening, or any other suitable tool connector. With respect to materials for the insert lock 204 components, the base 210 and expandable member 212 may be formed from strong, lightweight materials such as hard plastic or aluminum. Suitable materials for the movable member 214 include, but are not limited to, hard plastic, aluminum and steel.

Figure 8:
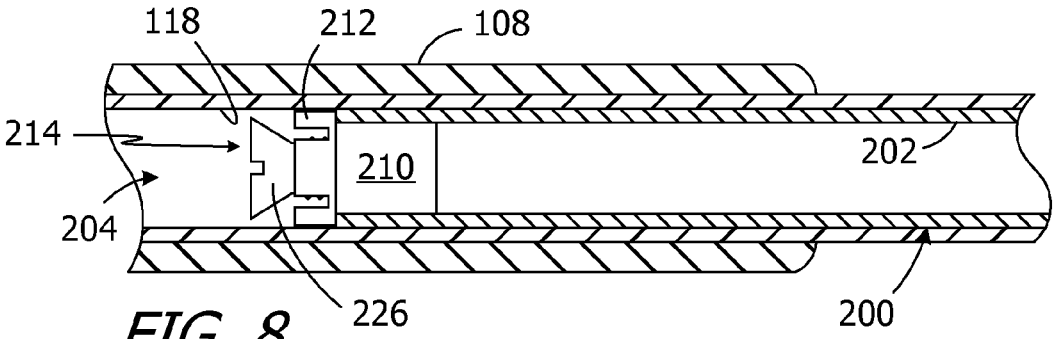
FIG. 8 is a partial section view showing the insert assembly illustrated in FIG. 2 in an unlocked state within a golf club shaft.
Figure 9:
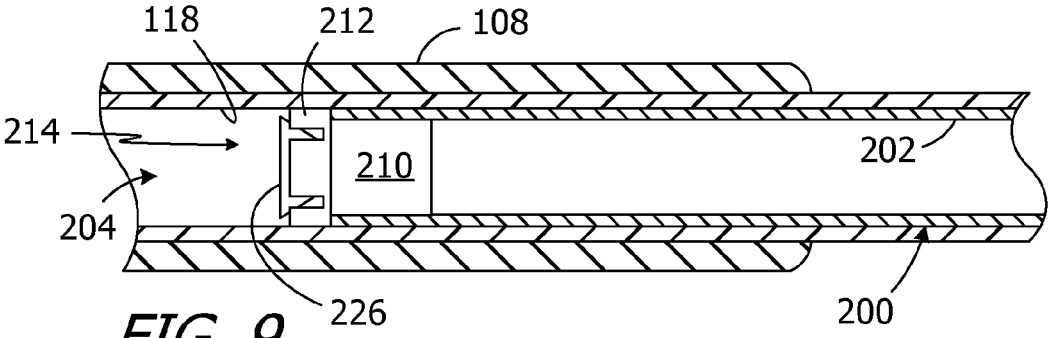
FIG. 9 is a partial section view showing the insert assembly illustrated in FIG. 2 in a locked state within a golf club shaft.

The exemplary insert lock 204 is shown in the unlocked state in FIGS. 5 and 8. There is a gap between the expandable member 212 and the engagement portion 226 of the longitudinally movable member 214. The insert lock 204 may be moved to the locked state illustrated in FIG. 9 by rotating the longitudinally movable member 214 relative to the base 210 until the longitudinally movable member drives the expandable portion 212 outwardly, as is described above, with enough force to frictionally engage inner surface 118 of the shaft 102 and prevent longitudinal movement of the insert assembly 200 relative to shaft.

Figure 10:
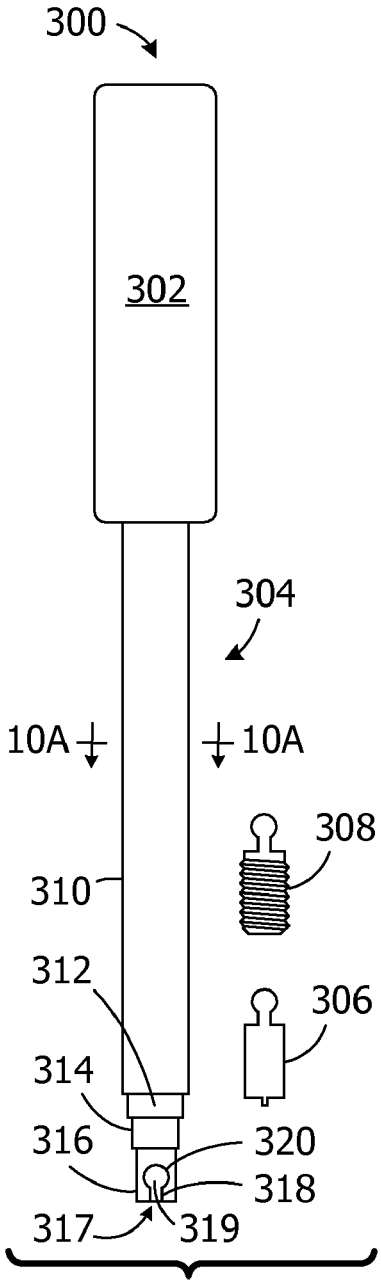
FIG. 10 is a plan view of an apparatus in accordance with one embodiment of a present invention.
Figure 10A:
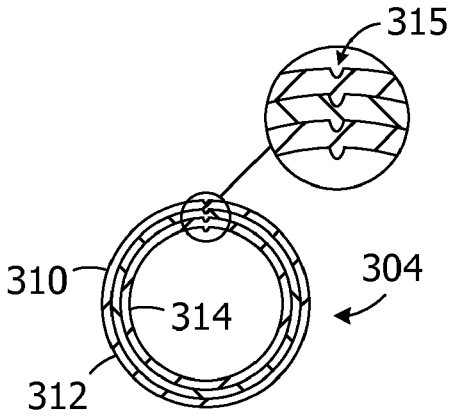
FIG. 10A is a section view taken along line 10A-10A in FIG. 10.
Figure 11:
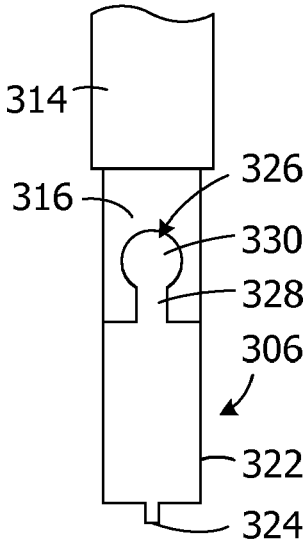
FIG. 11 is an enlarged view of the apparatus illustrated in FIG. 10 with the locking/unlocking bit attached.
Figure 12:
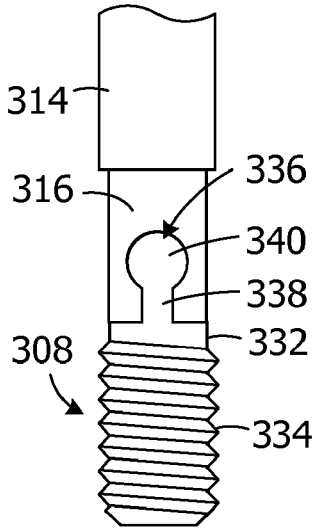
FIG. 12 is an enlarged view of the apparatus illustrated in FIG. 10 with the removal bit attached.

One example of an apparatus that may be used to lock and unlock the insert lock 204, and/or remove the insert assembly 200 from a golf club shaft (e.g. shaft 102), is generally represented by reference number 300 in FIGS. 10-12. The apparatus 300 includes a handle 302, a shaft 304, a locking/unlocking bit 306 and a removal bit 308. The exemplary handle 302 is sized to fit a human hand. The shaft 304 may be a solid rod or, as it is in the illustrated embodiment, a telescoping shaft. The exemplary telescoping shaft 304 includes a hollow outer portion 310 that is connected to the handle 302, a hollow mid-portion that 312 that is longitudinally slidable and rotationally fixed relative to the outer portion, a hollow inner portion that 312 that is longitudinally slidable and rotationally fixed relative to the mid-portion, and a bit connector 316 that is fixedly connected to the inner portion 314. The crimping arrangement 315 illustrated in FIG. 10A may, for example, be used to rotationally fix the shaft portions 310, 312 and 314 relative to one another.

The length of the apparatus shaft 304 should be sufficient to allow the user to lock, unlock and retrieve an insert assembly (e.g. the assembly 200*a*) that is located at or near the shaft tip section. The telescoping shaft 304 may, for example, have a fully compressed length of about 10 inches to 14 inches, and a fully extended length of about 26 inches to 30 inches. The apparatus 300 may also be provided with a device (not shown) that locks the telescoping shaft 304 at the fully compressed length, the fully extended length, and lengths therebetween. Although the apparatus 300 is not limited to any particular bit connector, the exemplary bit connector 316 is in the form of a solid rod having an opening 317, with a relatively narrow portion 318 and a relatively wide portion 320, that extends transversely through the solid rod. The opening 317 extends almost all the way, but not entirely, through the solid rod, thereby defining an end wall 319.

As illustrated for example in FIGS. 11 and 12, the locking/unlocking bit 306 includes a main portion 322, a tool 324 that is configured to mate with the tool connector 230 on the longitudinally movable member 214, and a connector 326 that is configured to mate with the bit connector 316. In the illustrated embodiment, the tool 324 is a rectangular bar that is sized and shaped to fit into the slotted opening type tool connector 230 on the longitudinally movable member 214. The connector 326 is configured to fit within the bit connector opening 317 and frictionally engage the shaft bit connector 316 so as to removably secure the locking/unlocking bit 306 to the apparatus shaft 304. To that end, the connector 326 includes a relatively narrow portion 328 and a relatively wide portion 330. The removal bit 308 includes a main portion 332, a tool 334 that is configured to mate with the lock base 210, and a connector 336 that is configured to mate with the bit connector 316. In the illustrated embodiment, the tool 334 is a threaded fastener that is sized and shaped to mate with the threaded lumen 216. The connector 336 is configured to fit within the bit connector opening 317 and frictionally engage the shaft bit connector 316 so as to removably secure the removal bit 308 to the tool shaft 304. To that end, the connector 336 includes a relatively narrow portion 338 and a relatively wide portion 340.

There is a wide variety of alternative mechanisms for securing the bits to the shaft. By way of example, but not limitation, the bits may be provided with a connector opening (e.g. the opening described above) and the shaft may be provided with a connector that fits into the opening on each bit. Ball and detent arrangements, such as those commonly found in socket wrenches may be employed.

Suitable materials for the bits 306 and 308 include, but are not limited to, hard plastic, aluminum and steel. The locking/unlocking bit 306 may also be formed from a magnetic material, in order to facilitate removal of the longitudinally movable member 214 from the golf club shaft during the insert assembly removal process described below.

Figure 13:
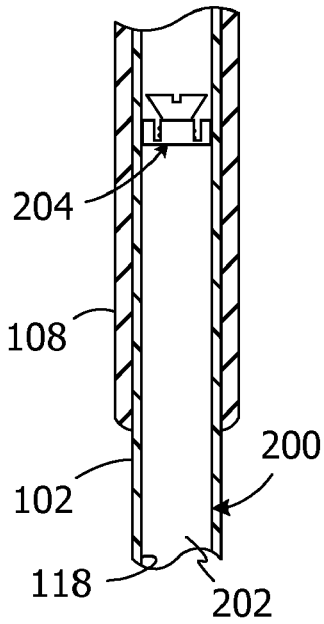
FIGS. 13-15 are partial section views showing the insert assembly illustrated in FIG. 2 being locked with the apparatus illustrated in FIG. 10.
Figure 14:
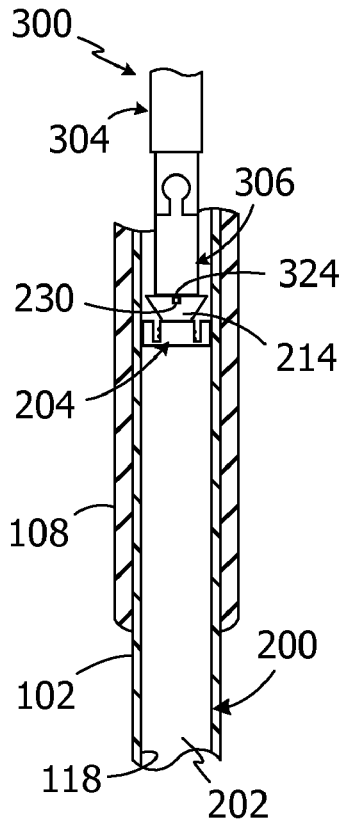
Figure 15:
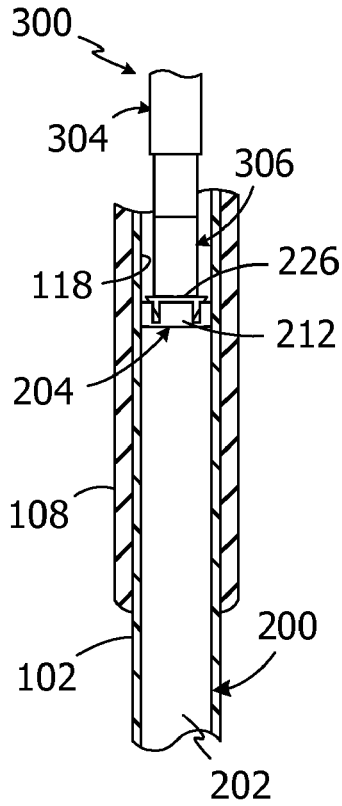

The exemplary apparatus 300 may be used to lock the insert lock 204 as part of the insertion/locking method illustrated in FIGS. 13-15. First, as illustrated in FIG. 13, the insert assembly 200 may be inserted into the golf club shaft 102 by way of the opening at the shaft butt end 114 and pushed (or allowed to fall) to the point at which the outer diameter of the insert 202 is substantially the same as the diameter of the inner surface 118 of the associated portion of the shaft and there is a press fit between the shaft and the insert. The apparatus 300 may then be inserted into the golf club shaft 102, by way of the same opening, with the locking/unlocking bit 306 attached to the shaft 304. Once the locking/unlocking bit tool 324 mates with the tool connector 230 on the longitudinally movable member 214, as is shown in FIG. 14, the apparatus 300 may be used to rotate the longitudinally movable member in the locking direction. Such rotation will continue until the engagement portion 226 expands the expandable member 212 into contact with the inner surface 118 of the golf club shaft 102, as is shown in FIG. 15, thereby locking the insert assembly 200 in place.

Figure 16:
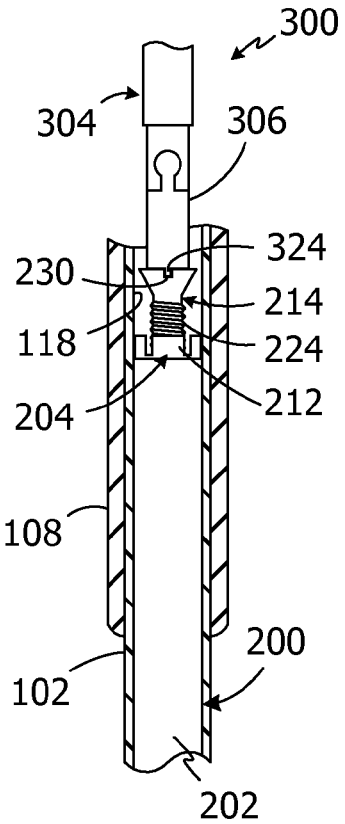
FIG. 16 is a partial section view showing the insert assembly illustrated in FIG. 2 being unlocked with the apparatus illustrated in FIG. 10.

The exemplary apparatus 300 may also be used to unlock the insert lock 204 and remove the insert assembly 200 from the shaft 102 as part of the unlocking/removal method illustrated in FIGS. 16-19. Referring first to FIG. 16, the apparatus 300 may be inserted into the golf club shaft 102 with the locking/unlocking bit 306 attached to the shaft 304. Once the locking/unlocking bit tool 324 mates with the tool connector 230 on the longitudinally movable member 214, the apparatus 300 may be used to rotate the longitudinally movable member in the unlocking direction. Such rotation will continue until the threaded shaft 224 on the longitudinally movable member 214 is beyond, and disengaged from, the threaded lumen 216 (note FIGS. 5-7). The longitudinally movable member 214 may then be removed from the golf club shaft 102 by simply turning the shaft upside down. Alternatively, in those instances where the locking/unlocking bit 306 is magnetic and the longitudinally movable member 214 is formed from a material with relatively high magnetic permeability (e.g. steel), the longitudinally movable member may be pulled out of the golf club shaft 102 with the apparatus 300.

Figure 17:
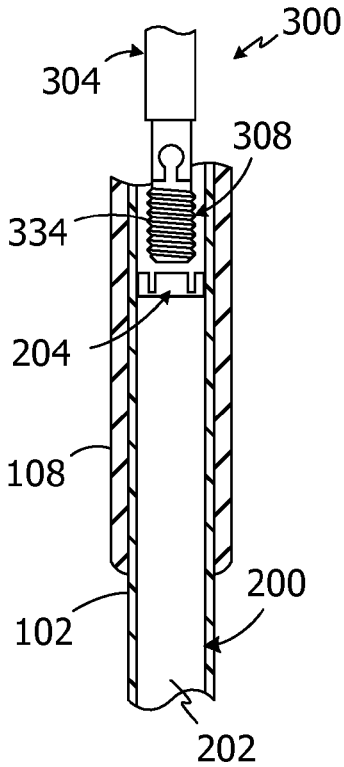
FIGS. 17-19 are partial section views showing the insert assembly illustrated in FIG. 2 being removed from a golf club shaft with the apparatus illustrated in FIG. 10.
Figure 18:
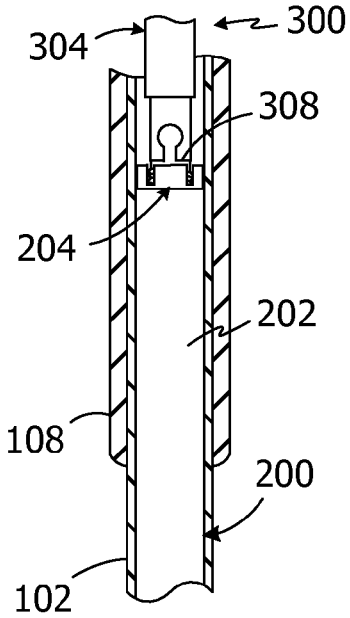
Figure 19:
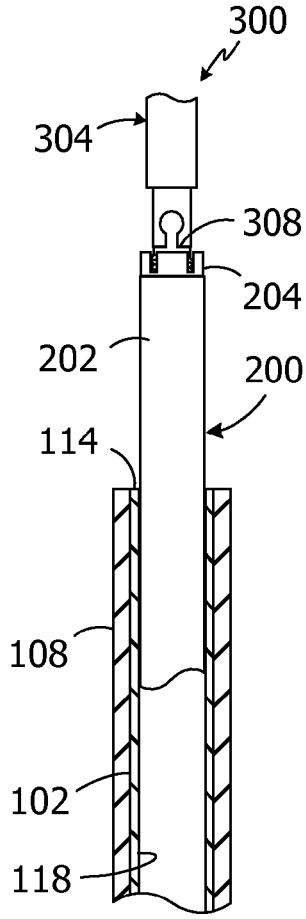

Next, as illustrated in FIG. 17, the removal bit 308 may be connected to the apparatus shaft 304 in place of the locking/unlocking bit 306 and inserted into the golf club shaft 102. The removal bit tool 334 in the exemplary embodiment is a threaded fastener that is sized and shaped to mate with the threaded lumen 216 (note FIGS. 5-7). Once the removal bit tool 334 reaches the threaded lumen 216, the apparatus 300 may be rotated until the removal bit tool is located in the position illustrated in FIG. 18 and connected to the base 210. Next, as illustrated in FIG. 19, the apparatus 300 may be used to pull the insert assembly 200 out of the golf club shaft 102 by way of the opening in the butt end 114.

It should be noted here that, because the insert assembly 200 is positioned somewhat close to the butt end 114 of the golf club shaft 102, the telescoping shaft 304 need not be extended, or may be only slightly extended, when the apparatus 300 is being used to lock or unlock the insert lock 204, or remove the insert assembly 200 from the shaft. The apparatus 300 may, however, also be used to remove an insert assembly that is located near the tip end of a golf club shaft (e.g. the insert assembly 200*a* illustrated in FIG. 4). Here, the telescoping shaft 304 will typically be fully extended (or close to fully extended) so that it can extend through a substantially majority of the overall length of the golf club shaft 102.

Figure 20:
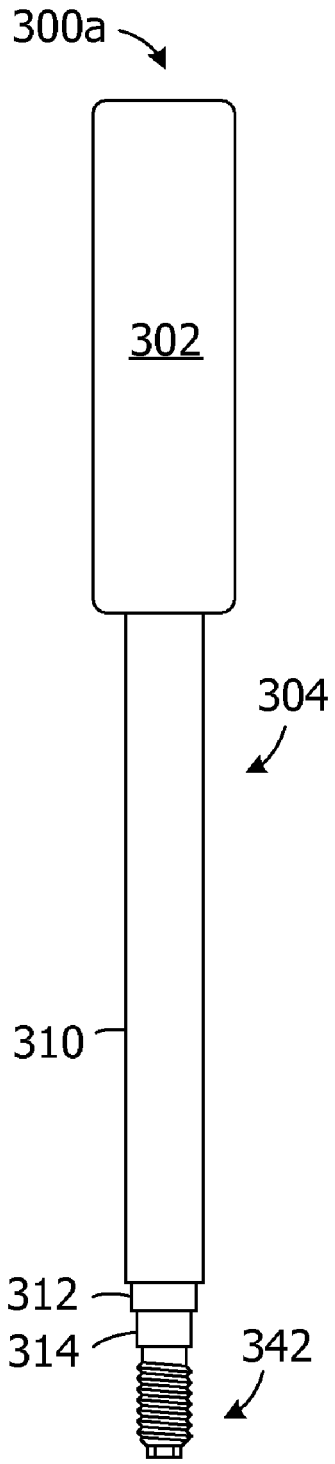
FIG. 20 is a plan view of an apparatus in accordance with one embodiment of a present invention.

Another example of an apparatus that may be used to lock and unlock an insert lock, and/or remove an insert assembly from a golf club shaft (e.g. shaft 102), is generally represented by reference number 300*a* in FIG. 20. The exemplary apparatus 300*a* is similar to apparatus 300 and similar elements are represented by similar reference numerals. For example, apparatus 300*a* includes the exemplary handle 302 and shaft 304 that are described in more detail above. The shaft 304 may be a solid rod or, as shown, a telescoping shaft that includes a hollow outer portion 310 that is connected to the handle 302, a hollow mid-portion that 312 that is longitudinally slidable and rotationally fixed (e.g. by crimping) relative to the outer portion, a hollow inner portion that 312 that is longitudinally slidable and rotationally fixed (e.g. by crimping) relative to the mid-portion. Here, however, instead of the above-described locking/unlocking bit 306 and removal bit 308, the apparatus 300*a* includes a dual-use device 342 that may be used to perform the locking, unlocking and removal functions performed by the bits 306 and 308. The dual-use device 342 is permanently secured to the shaft 304 in the exemplary embodiment. Nevertheless, in other implementations, the dual-use device may be in removable bit form so that it can be removably secured to the shaft 304 in the various manners described above in the context of the bits 306 and 308.

Figure 21:
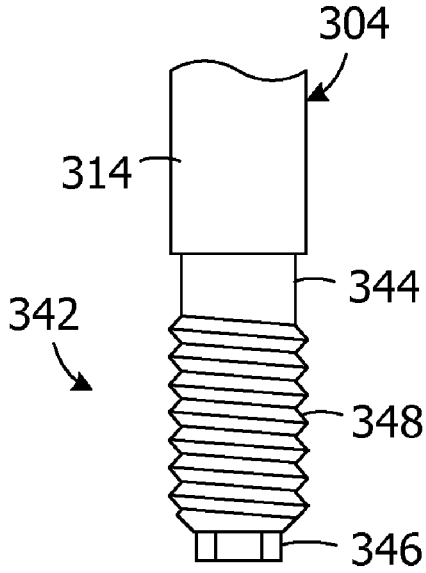
FIG. 21 is an enlarged view of a portion of the apparatus illustrated in FIG. 20.
Figure 22:
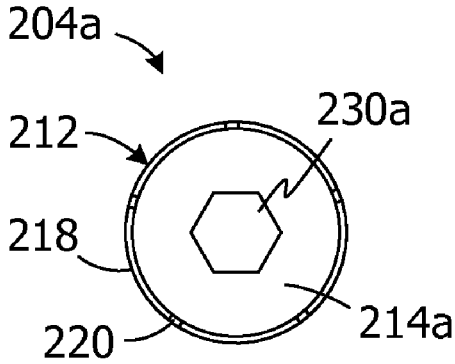
FIG. 22 is a top view of an insert lock in accordance with one embodiment of a present invention.

Referring to FIG. 21, the exemplary dual-use device 342 is an integral (or "one piece") structure which includes a base 344 that is connected to the shaft 304, a locking/unlocking tool 346 and a removal tool 348. The exemplary dual-use device 342 is configured to be used in conjunction with an insert assembly with the insert lock 204*a* illustrated in FIG. 22, which is identical to the insert lock 204 but for the inclusion of a movable member 214*a* with a connector 230*a* that is in the form of a Hex opening. As such, the locking/unlocking tool 346 is a Hex head that is configured to fit into the Hex opening, while the removal tool 348 is a threaded fastener that is sized and shaped to mate with the insert lock threaded lumen 216 (note FIGS. 5-7). The dual-use device 342 may also be reconfigured for use with the insert lock 204 by substituting a rectangular bar for the Hex head, or reconfigured for use with other types of movable member connectors (e.g. a Phillips opening or a square Robertson opening). Suitable materials for the dual-use device 342 include, but are not limited to, hard plastic, aluminum, steel, and magnetic materials.

The exemplary apparatus 300*a* may be used to lock, unlock and remove an insert assembly in manners similar to those described above with reference to FIGS. 13-19. Here, however, the user will not be required to substitute one bit for another when switching from between the locking/unlocking and removal operations.

Although the present inventions have been described in terms of the preferred embodiments above, numerous modifications and/or additions to the above-described preferred embodiments would be readily apparent to one skilled in the art. By way of example, but not limitation, the present inventions include golf club shafts and golf clubs (e.g. a shaft and a club head) in combination with the insert assemblies described above and defined by the claims below. The golf clubs may also include a grip and an end cap. The present inventions also include insert assembly sets having multiple insert assemblies that are sized to be positioned near the grip section and multiple insert assemblies that are sized to be positioned near the tip section, as described above and defined by the claims below, with inserts of different length, stiffness and/or bending moment. The present inventions also include kits consisting of a removal tool and one or more of the insert assemblies described above and defined by the claims below. It is intended that the scope of the present inventions extend to all such modifications and/or additions.

I claim:

1. An apparatus for use with a golf club shaft and a shaft insert assembly that includes a shaft insert and an insert lock having a base with a threaded lumen, the apparatus comprising:

a telescoping apparatus shaft;

a first tool permanently associated with the telescoping apparatus shaft and configured to engage the insert lock; and a threaded fastener permanently associated with the telescoping apparatus shaft and configured to mate with the threaded lumen.

2. An apparatus as claimed in claim 1, wherein the insert lock includes a longitudinally movable member with an opening; and the first tool is configured to fit within the opening.

3. An apparatus as claimed in claim 1, wherein the first tool and the threaded fastener are part of a single dual-use device.

4. An apparatus as claimed in claim 3, wherein the single dual-use device includes a first longitudinal end associated with the apparatus shaft and a second longitudinal end; and the first tool comprises a protrusion that defines the second longitudinal end.

5. An apparatus as claimed in claim 4, wherein the protrusion comprises a Hex head.

6. An apparatus for use with a golf club shaft and a shaft insert assembly that includes a shaft insert and an insert lock, the apparatus comprising:

a telescoping apparatus shaft configured to fit within the golf club shaft;

a first tool permanently associated with the telescoping apparatus shaft, configured to fit within the golf club shaft and configured to engage the insert lock; and a second tool permanently associated with the telescoping apparatus shaft, configured to fit within the golf club shaft and configured to be removably secured to the insert assembly in response to rotation of the second tool relative to the insert assembly.

7. An apparatus as claimed in claim 6, wherein the insert lock includes a longitudinally movable member with an opening; and the first tool is configured to fit within the opening.

8. An apparatus as claimed in claim 6, wherein the insert lock includes a base with a threaded lumen; and the second tool comprises a threaded fastener configured to mate with the threaded lumen.

9. An apparatus as claimed in claim 6, wherein the first and second tools are part of a single dual-use device.

10. An apparatus as claimed in claim 9, wherein the single dual-use device includes a first longitudinal end associated with the telescoping apparatus shaft and a second longitudinal end;

the first tool comprises a protrusion that defines the second longitudinal end; and the second tool comprises a threaded fastener.

11. An apparatus as claimed in claim 10, wherein the protrusion comprises a Hex head.

* * * * *